US009328546B1

(12) United States Patent
Davis

(10) Patent No.: US 9,328,546 B1
(45) Date of Patent: May 3, 2016

(54) HAND AND FINGER PROTECTOR FOR USE WITH DOORS

(71) Applicant: Raymond E Davis, Dallas, TX (US)

(72) Inventor: Raymond E Davis, Dallas, TX (US)

( * ) Notice: Subject to any disclaimer, the term of this patent is extended or adjusted under 35 U.S.C. 154(b) by 0 days.

(21) Appl. No.: 14/726,686

(22) Filed: Jun. 1, 2015

Related U.S. Application Data

(63) Continuation-in-part of application No. 14/628,242, filed on Feb. 21, 2015.

(51) Int. Cl.
*E05D 11/00* (2006.01)
*E06B 7/36* (2006.01)

(52) U.S. Cl.
CPC ..... *E05D 11/0054* (2013.01); *E06B 7/36* (2013.01); *E06B 7/362* (2013.01); *E05D 2011/0072* (2013.01)

(58) Field of Classification Search
CPC ..... E06B 7/36; E06B 7/362; E06B 2007/365; E06B 7/367
USPC ..... 49/383, 384
See application file for complete search history.

(56) References Cited

U.S. PATENT DOCUMENTS

| | | | | |
|---|---|---|---|---|
| 399,413 | A * | 3/1889 | Jones | E06B 7/18 292/DIG. 70 |
| 1,400,788 | A * | 12/1921 | Barrow | E06B 7/362 16/250 |
| 1,484,024 | A * | 2/1924 | Hedman | E06B 7/362 49/384 |
| 2,681,479 | A * | 6/1954 | Dixon, Sr. | E06B 7/367 49/383 |
| 4,878,267 | A * | 11/1989 | Roach | E06B 7/367 16/250 |
| 6,044,601 | A * | 4/2000 | Chmela | E04F 19/028 248/345.1 |
| 6,298,605 | B1 * | 10/2001 | Delefosse | E06B 7/367 49/381 |
| 6,314,688 | B1 * | 11/2001 | Ford | A62B 99/00 52/101 |
| 7,155,776 | B2 | 1/2007 | Park | |
| 7,281,300 | B2 | 10/2007 | Andersen et al. | |
| 7,331,617 | B2 | 2/2008 | Johnson | |
| 7,416,230 | B2 | 8/2008 | Konstantakis et al. | |
| 7,537,250 | B1 | 5/2009 | Gustafson | |
| 2003/0070256 | A1 | 4/2003 | Kuwica | |

* cited by examiner

*Primary Examiner* — Gregory Strimbu

(57) ABSTRACT

A hinge stile gap blocking apparatus to prevent hand and finger injuries resulting from inadvertent door closings. The apparatus includes a hinge gap cover for use with an existing door and door jamb and configured to continuously occlude a gap between the door jamb and the outer facing edge of a hinge stile of the door. The hinge stile gap blocking apparatus has a curved portion that is shaped such that the door edge tracks the curve when the door is pivoted between an open and a closed position and from the closed to the open position. A method of installing the hinge stile gap blocking apparatus is also disclosed.

5 Claims, 7 Drawing Sheets

HAND AND FINGER PROTECTOR FOR USE WITH DOORS

FIELD OF THE INVENTION

This invention relates to the field of injury prevention devices and more particularly, devices and methods to insure the safe operation of doors.

BACKGROUND OF THE INVENTION

The open area of a door hinge frequently attracts the eyes and exploring fingers of small children and accounts for 55% of door related injuries. If the door closes while fingers are within this area, as much as 40 tons of pressure per square inch is created easily crushing or pulverizing human tissue, and amputating fingers.

It has been reported that according to the National Safety Council—Injury Facts 2011 Edition; U.S. Consumer Product Safety Commission's National Electronic Injury Surveillance System, that approximately 380,800 door related injuries occur in the United States every year. Door related injuries occur at a rate of 31,000 month, 1,000 every day, 42 every hour and 1 every 1.4 minutes. According to one study; Clinical Pediatric Study: "Children Treated in the United States Emergency Departments for Door-related Injuries, 1999-2008", approximately eighty percent of door-related injuries occur to children in the home and approximately forty two percent of these children were under the age of four. Thousands of children every year are sent to the hospital with fractures, crushed and pulverized tissue or broken bones because portions of fingers and hands were caught in slamming doors.

Door injuries are very serious, disastrous, and potentially life changing. Amputations are a triple threat involving loss of function, loss of sensation, and loss of body image causing postoperative complications such as psychological problems, phantom pain, adverse emotional health, and needed psychosocial support. Individuals who earn their living from motor skills are especially vulnerable to amputations. Amputation in the preadolescent or adolescent age group is a great threat to emerging self image and sexual identity, and elderly amputees are at a greater risk for psychiatric disturbances such as depression, social isolation, new financial stringencies, and occupational limitations which complicate the adjustment to serious door hand injuries or finger amputations.

The true incidence of door-related injuries is underestimated because not all door related injuries are treated in hospital Emergency Departments and urgent care centers do not report statistics. Of the reported cases, tens of thousands of door related injuries result in finger amputations to children. Even one door injury is too many. Embodiments of the present invention can prevent most if not all of this type of injury.

The present invention will not only prevent injury to children by unintended door closings, but will mitigate real potential legal and financial liability to many public and private facilities. There are many potential legal theories under which these public and private facilities having known and foreseeably unsafe doors can be found legally liable for these injuries including: premises liability, landowner-occupier duties, general negligence, attractive nuisance doctrine, and products liability. For example, under the attractive nuisance doctrine, where the trespass of a child is likely, a landowner owes a duty to exercise ordinary care to avoid a foreseeable risk of harm posed by known dangerous artificial conditions, which result from the child's inability to appreciate the risk of harm. Many heavy commercial doors in commercial buildings readily attract children. Some of these doors and door surrounds have attractive shiny metallic finishes or bright colored paint baiting the eyes and fingers of child. Doors are easily accessible to the exploring fingers of young children who are unable to appreciate the dangerous condition.

Liability under the attractive nuisance doctrine can be imposed now that the inventor's known door hinge safety device can be installed at a small cost relative to overall door installation. Thus, the cost of eliminating the known dangerous artificial condition of the finger amputating door is not so burdensome and the duty to install should be afforded even with respect to child trespassers.

Landowner or occupier liabilities can be found significantly more easily than under the attractive nuisance doctrine since landowners or occupier liability extends to licensees and/or invitees when they are injured in the face of known and foreseeable risks posed to them.

DESCRIPTION OF PRIOR ART

Major problems face current users of door safety closure prevention devices inasmuch as many such devices require modifications to door or door frame construction. Moreover, such devices do not fully and effectively occlude a door hinge gap when the door is transitioned from an open position to a closed position and from a closed position to an open position sufficient to prevent hands and fingers from being crushed, injured, or amputated. Further, many door safety closure prevention devices are just movable stops that many times get displaced from their original intended position and fail to prevent a door from closing.

For at least the foregoing reasons, there is a need for a door safety closure device that will prevent hands and fingers from being crushed, injured, or amputated within the hinge area of the door and door surround. Moreover, the invention will prevent the economic loss of serious door injuries resulting from loss of livelihood, increased government disability payments, and diminished functional capacity of the amputees. Further, the invention will mitigate financial and legal liability that is created under legal causes of action filed under premise liability, landowner-occupier liability, general negligence, attractive nuisance doctrine, or products liability law suits.

SUMMARY

The present invention is directed to a hand and finger door protector for residential and commercial doors that will protect hands and fingers from being crushed, injured, or amputated in a hinge gap of the door and door surround by the unintended slamming or closing of the door. Embodiments of this invention are designed to be used with any type of pivoting door and continuously occlude the hinge gap of the door at any door position and during any transition from one position to another.

Embodiments of the apparatus and method disclosed herein prevent injury to body parts resulting from door closure. Embodiments described herein achieve injury prevention by the steps of providing a door frame and a door wherein portions of the door frame are installed with a specially shaped apparatus having portions that occlude the hinge gap of a door when opening or closing the door. More specifically, a hinge gap blocking apparatus has a curved portion that is shaped to match the arc of an inner edge of a door hinge stile when the door is pivoted from an open to closed position and from a closed to an open position. The apparatus is sufficiently rigid so that fingers cannot pry around the curved portion and thus risk exposure to the hinge gap of the door.

The hinge gap blocker apparatus is attached to an inside facing surface of a door frame, and includes a plate for affixing to the door frame and a curved portion that once installed, resides against the door frame, adjacent to the inner edge of the door hinge stile. When the door is pivoted on its hinges, the inner edge of the door hinge stile slidably tracks the surface of the curved portion so that the hinge stile gap is occluded at all times.

FACTORS AND ASPECTS OF THE INVENTION

First, the inventor is not aware of existing hand and finger door safety devices that occlude the hinge stile gap of a door in the manner of the present invention.

Second, embodiments of this invention include fastening means for attaching the hinge gap blocker to a door jamb that include one or more mounting portions, portions of which may be aligned with portions of the door jamb and which may be affixed to the inside of a door frame using nails, threaded fasteners, brush on adhesives, adhesives with a peel away backing, or other such fastening means as will suggest themselves those skilled in the art, facilitating quick installation. The mounting portion includes a substantially flat plate with apertures for insertion of threaded fasteners, or, on the side facing a door jamb, a layer of adhesive exposed by a peel away backing. The mounting portion may include piercing tabs or points (not shown) on the door jamb facing side that may be driven into a wooden or plastic door jamb.

Third, embodiments of the apparatus may possess one or more sections for spanning the distance of an inner door frame above, below and between hinges.

Fourth, embodiments of the present invention may include method(s) to produce multiple sections of a hinge stile gap blocker; e.g., by severing, sawing or separating smaller sections from a larger section wherein the smaller sections are custom fitted to span the distance of door frame between hinges, or, embodiments may include pre-sized section(s) that bridge hinge portion(s) to provide a continuous outwardly facing section of a hinge stile gap blocker.

For at least the foregoing reasons, there is a need for apparatus and method designed to prevent injuries resulting from placement of fingers and hands into the hinge stile gap of open doors. Embodiments of the invention, the details and features of which are shown in the drawing figures and detailed description that follow will reduce the risk of hand and finger injuries and amputations, lessen the economic loss of serious door injuries due to loss of livelihood, lessen government disability payments, prevent amputation and the sequelae of diminished functional capacity of the amputees and reduce the risk of legal causes of action against premises having foreseeably dangerous doors.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

Figure 9:
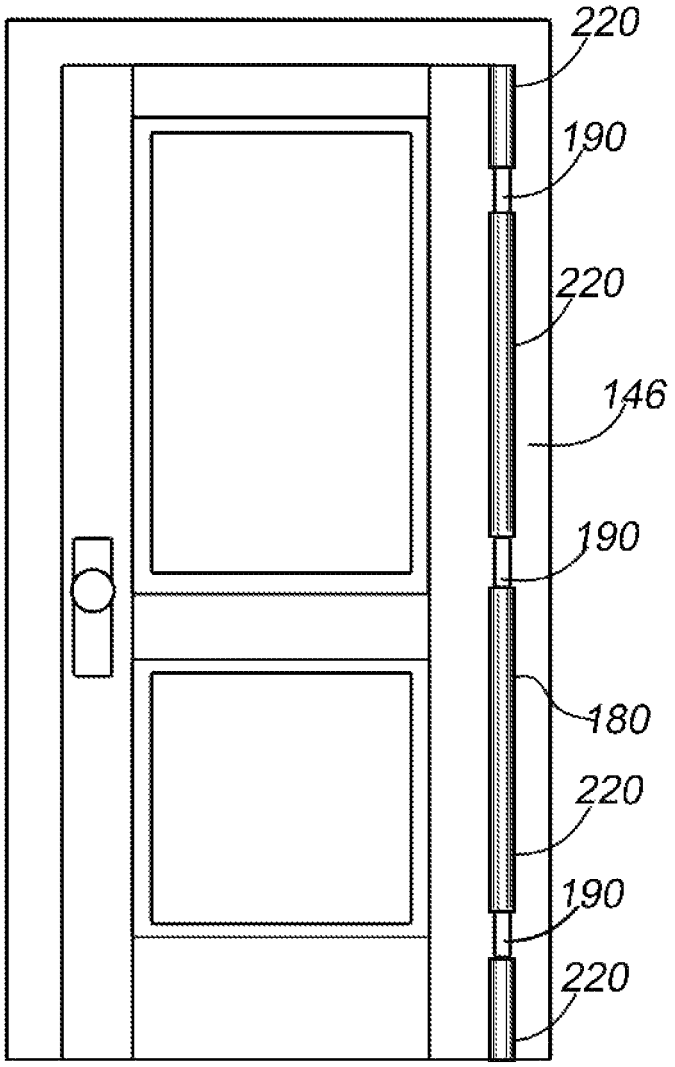

FIG. 9 as seen from the outward facing side of a door, illustrates an exemplary installation according to the present invention with hinge stile gap blockers residing above and below hinges, and spanning the distance between hinges.

REFERENCE LISTING OF THE NUMBERED ELEMENTS

100 door
120 door leading edge
130 door surround
140 door frame
142 door jamb
144 door jamb stop
146 door casing
150 inner edge hinge stile
160 outer edge hinge stile
180 hinge stile gap
190 door hinge
200 hinge stile gap blocker
210 plate top side
211 plate bottom side
212 adhesive
213 backing
214 fastener aperture
220 curved portion
221 outward face
222 inward face
230 end

DEFINITIONS

In the following description, the term "door" as used herein, includes pivoting or hinging panels that are designed to occlude a doorway. The term "complete door closure" as used herein, means the edge of the door is substantially flush with a door surround and wherein there is minimal gap between the edges of the door and the frame. The term "door surround" as used herein, means the structure surrounding a door, whether outward facing or inward facing, and includes raised molding (casing), or other non-raised surface, e.g., wall or cabinetry surfaces directly adjacent to—or abutting the door's edge(s). The term "door jamb" as used herein, refers to portions of the door frame that are typically at a right angle relative to the casing of the door when the door is shut. The term "leading edge" also known as the "shutting stile," refers to that portion of a door that leads when the door is being moved from an open to closed position; e.g., the lock stile of a rail and stile door. The term "hinge stile" refers to the vertical portion of a door edge to which hinges are affixed and about which the door pivots. The term "hinge stile gap" refers to the gap created between the back edges of a door and a door frame when the door is partially or wholly opened. As used herein, "fasteners" means any customary means to fasten one object to another, including threaded fasteners, non-threaded fasteners, staples, tape, adhesives, welding, or other means as will be appreciated by those having skill in the art and benefit of this disclosure whether for permanent or semi-permanent use. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

Referring generally to FIGS. 1-9, embodiments according to the present invention for a hand and finger protector and a method for preventing injuries resulting from insertion of hands and fingers into a hinge stile gap 180 of a door 100 include, a door hinge stile gap blocker 200 having an mounting portion; typically a plate having a top side 210 and bottom side 211 for attachment and alignment to portions of a door jamb, and a curved portion 220 extending from the mounting plate; typically a sectioned or incomplete cylindrical member (FIG. 3), portions of which possess a curvilinear profile that matches the travel path of an inner edge 150 of a door hinge stile when the door is pivoted, such that the inner edge of the hinge stile slidably abuts the curved portion or passes very closely to the curved portion when being opened or closed. Once installed, the hinge stile gap 180 is occluded by the hinge stile gap blocker irrespective of door position. While in the embodiments depicted herein, the curved portion 220 affixed to the plate, it is possible that the curved portion may be unitary with the plate, or a separate element paired with the plate prior to, or during installation. The curved portion may have any radius sized appropriately for any pivoting door. Typically, the apparatus is a multi-part assembly wherein sections are aligned with a stop 144 of a door jamb 142. Sections of the apparatus may be fastened to the door jamb by any means that will be appreciated by those skilled in the art, including threaded fasteners, nails or adhesives. For example, in some cases, a light tack adhesive 212 on an underside 211 of the plate exposed by a peel-away backing 213 can be used to temporarily position or reposition sections of the hinge stile gap blocker so that the inner edge of the hinge stile tracks the arc of the outward face 221 of curved portion 220 closely. Once positioned, the sections may be fastened more securely to the door jamb, with threaded fasteners or other suitable means that will be appreciated by those having skill in the art. While one preferred material for the mounting plate and curved portion is stamped and formed metal, rigid or semi-rigid plastics, or, a combination of materials including elastomers may be used. The hinge stile gap blocker may be provided in multiple sections of pre-determined length, or, one or more sections may be cut to length by an installer such that the sections fitted above, below and between hinges (FIG. 9). In some cases, the curved section may be a plastic extrusion that is solid or hollow. In other cases, where the curved section is bent or otherwise formed sheet metal and connector (s) and/or plug(s) (not shown) which are insertable into ends 230 of the hinge gap blocker, may be used to respectively, join multiple sections together and cap exposed ends.

Embodiments of the hinge stile gap blocking apparatus may be retrofitted to an existing door and door jamb, or, embodiments may be pre-installed on pre-hung doors. Alternately, the apparatus of the invention may be provided in a kit form for retrofitting to existing installed doors. It is also conceivable that the hinge stile blocking apparatus be incorporated into wood, plastic or metal door jambs at the time of manufacture.

Figure 1:
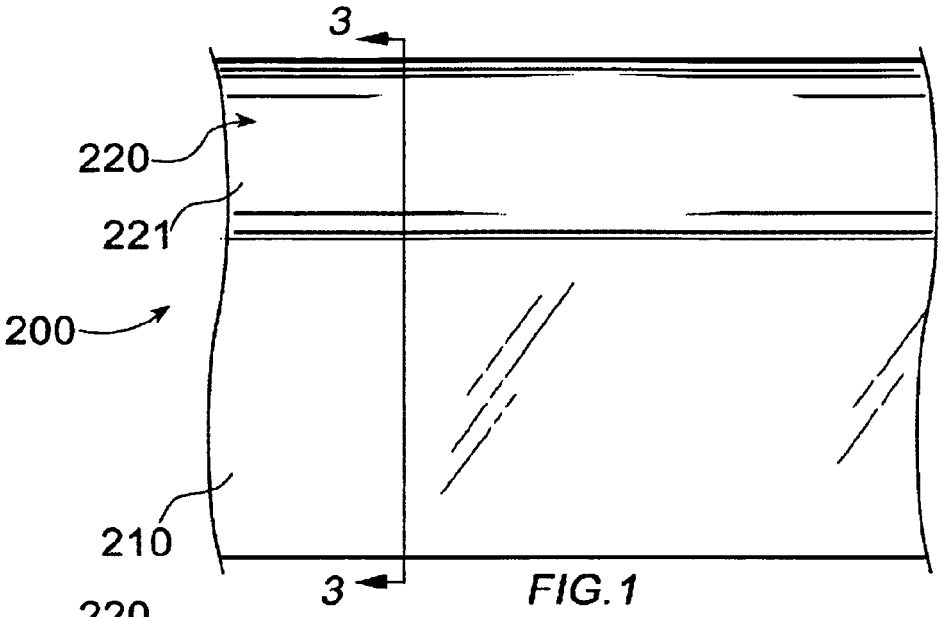
FIG. 1 is a top plan view of a partial section of one embodiment according to the present invention.
Figure 2:
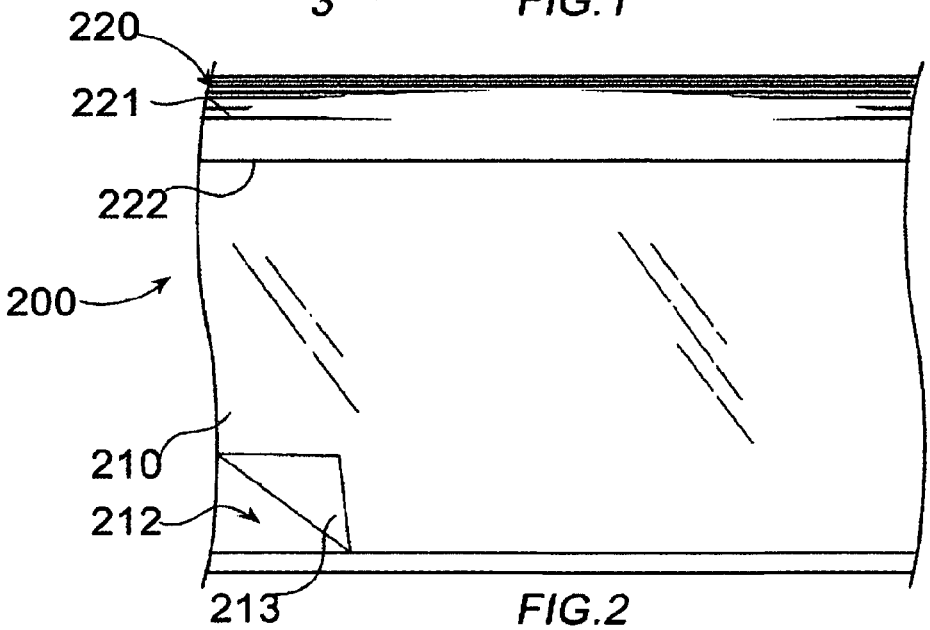
FIG. 2 is a back plan view of one embodiment of the present invention.
Figure 3:
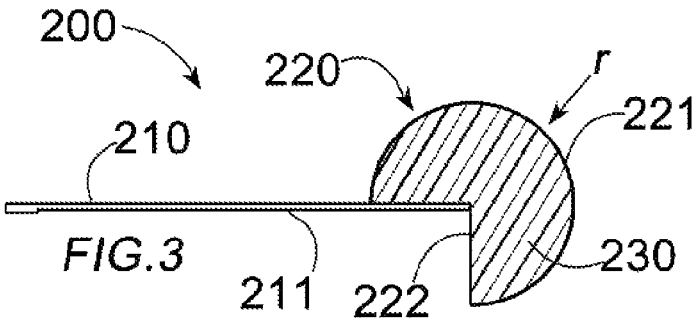
FIG. 3 is cross-sectional view of one embodiment of the present invention taken from the direction of lines 3-3 of FIG. 1.
Figure 4:
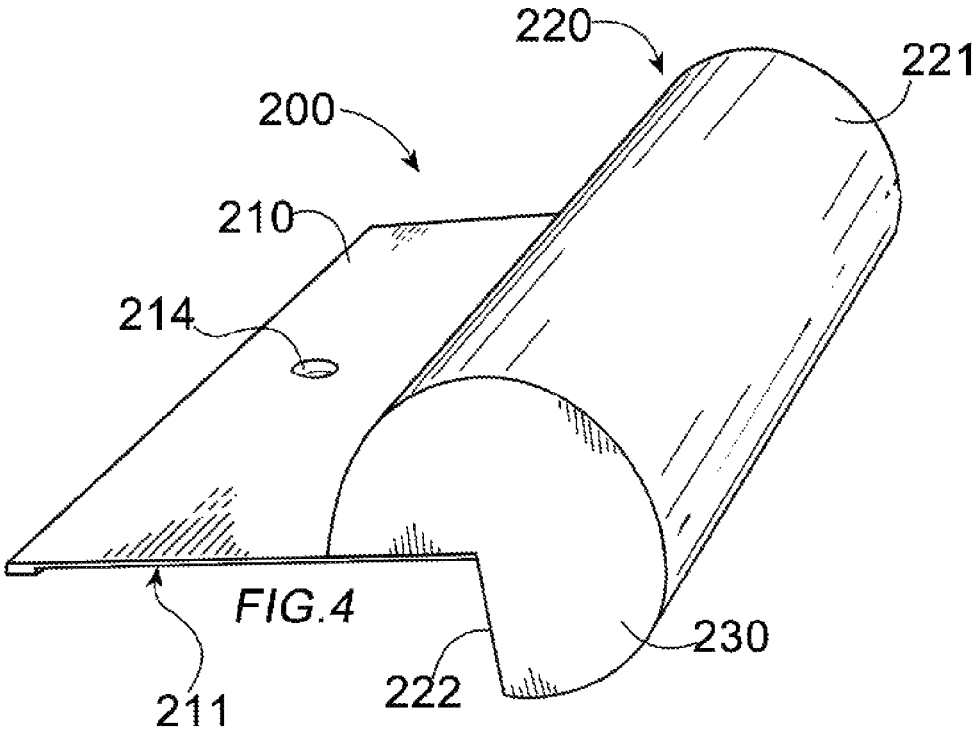
FIG. 4 is a perspective view of one embodiment of the present invention.

FIGS. 1 and 2 show respectively, a top plan view and bottom plan view of a section of one embodiment according to the present invention. FIG. 3 is a cross-sectional view of (FIG. 1) taken along lines 3-3 showing plate portion top side 210 underside 211 and curved portion 220. In the particular embodiment depicted in FIGS. 1-4, the curved portion includes a plastic or elastomeric body preferably constructed of a resilient material such as a urethane with shore-A value between 50 and 80, to flex slightly in order to accommodate surface irregularities that may be found on the inner edge of the hinge stile that slidably abuts the curved portion once the hinge stile gap blocker is installed. Plate portion 210, 211 aligns with and fits to inside surfaces of a door jamb, and, is fastened thereon by threaded or unthreaded fasteners, brush on adhesives, spray on adhesives, pre-applied adhesives, e.g., with a peel away backing, or, other suitable fasteners. As best shown in (FIG. 7), curved portion 220 is an incomplete cylinder that has been sectioned longitudinally providing an inward face 222 that fits against the outside corner of a door jamb.

Figure 5:
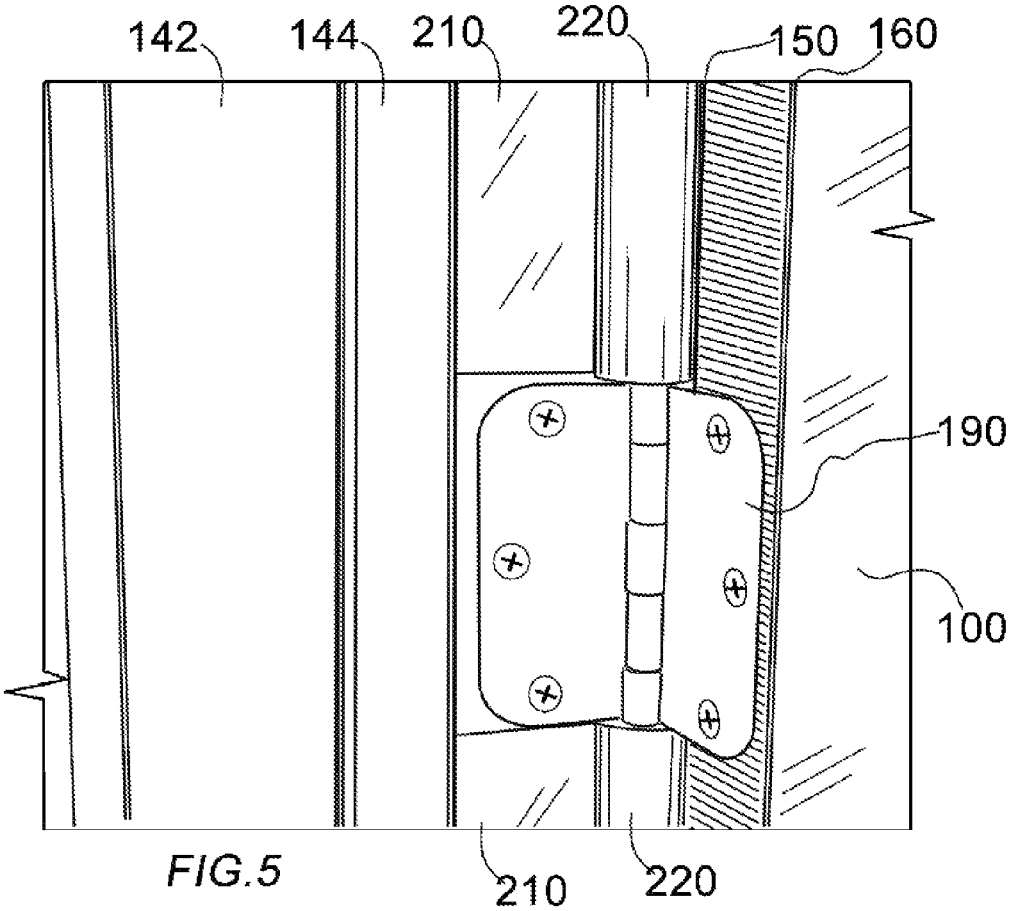
FIG. 5 is a perspective view depicting an exemplary installation according to an embodiment of the invention taken from the inside of a door.

FIG. 5 depicts in a perspective view, the nexus of a door jamb and a hinge stile of a door, and a multi-sectional embodiment installed to the door jamb between hinges 190, which intrudes into the hinge stile gap between the jamb and door when the door is opened. Inner edge 150 of the door hinge stile slidably abuts curved portion 220 when the door is pivoted.

Figure 6:
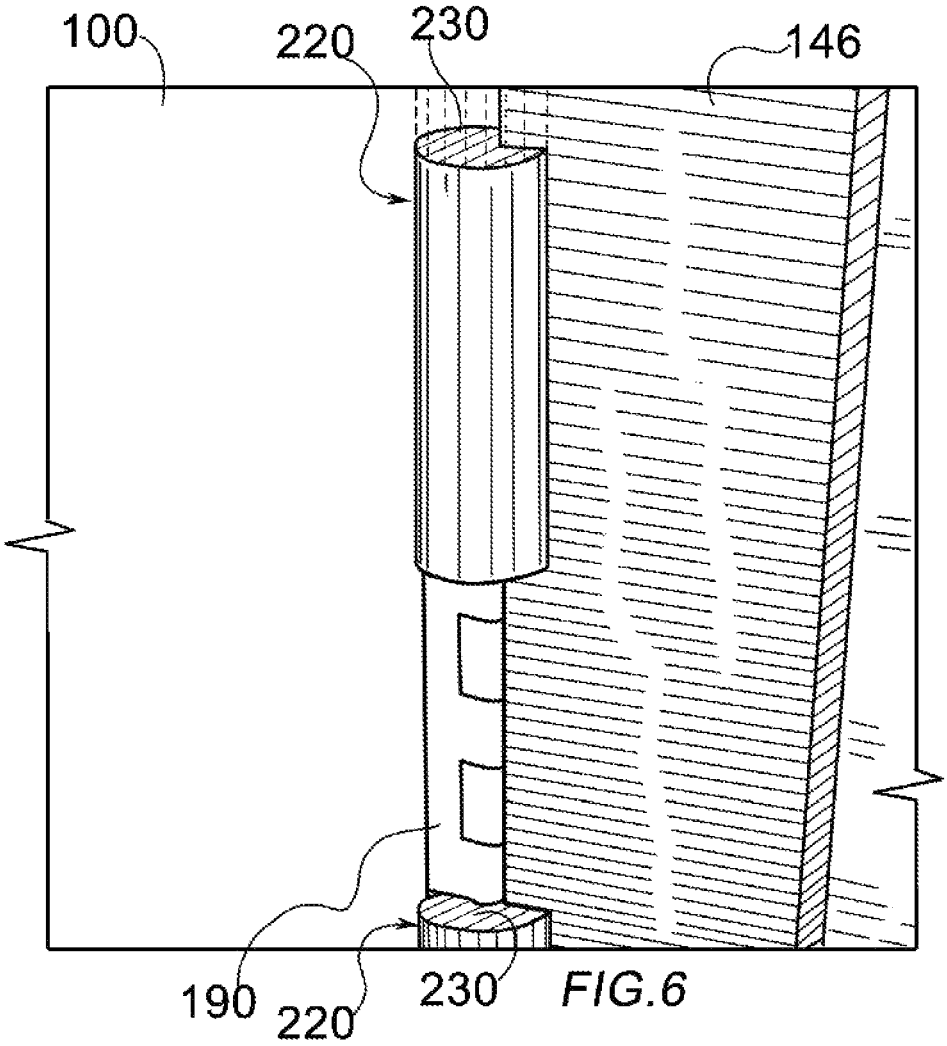
FIG. 6 is a perspective view depicting an exemplary installation according to an embodiment of the invention taken from the outside of a door.

FIG. 6, in a view taken from the opposite side of the door shown in (FIG. 5), shows the relationship of the door and door casing 146 and how curved portion 220 of the hinge stile gap blocker 200 extends into the hinge stile gap 180 between and beyond the door and the casing. Dashed lines shown above the topmost hinge gap blocker section indicate a continuation of the section.

Figure 7:
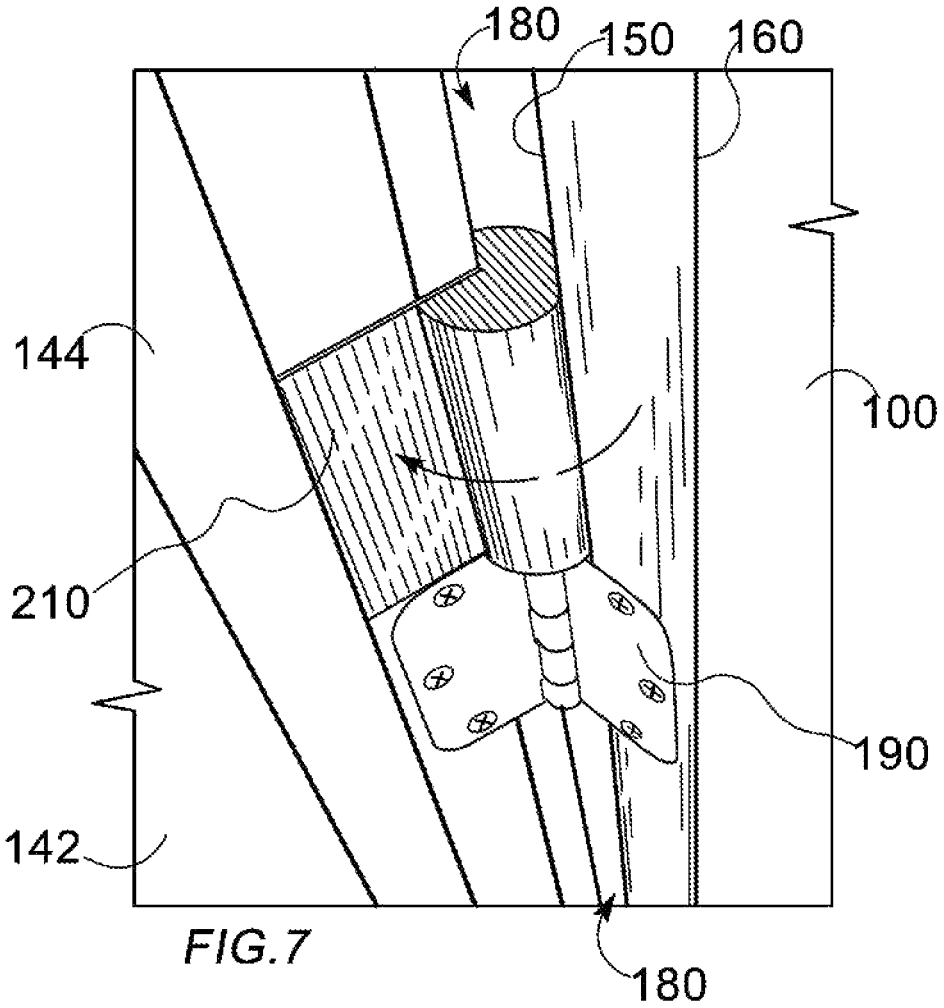
FIG. 7 is a perspective view depicting an exemplary installation according to an embodiment of the invention taken from the inside of the door.
Figure 8:
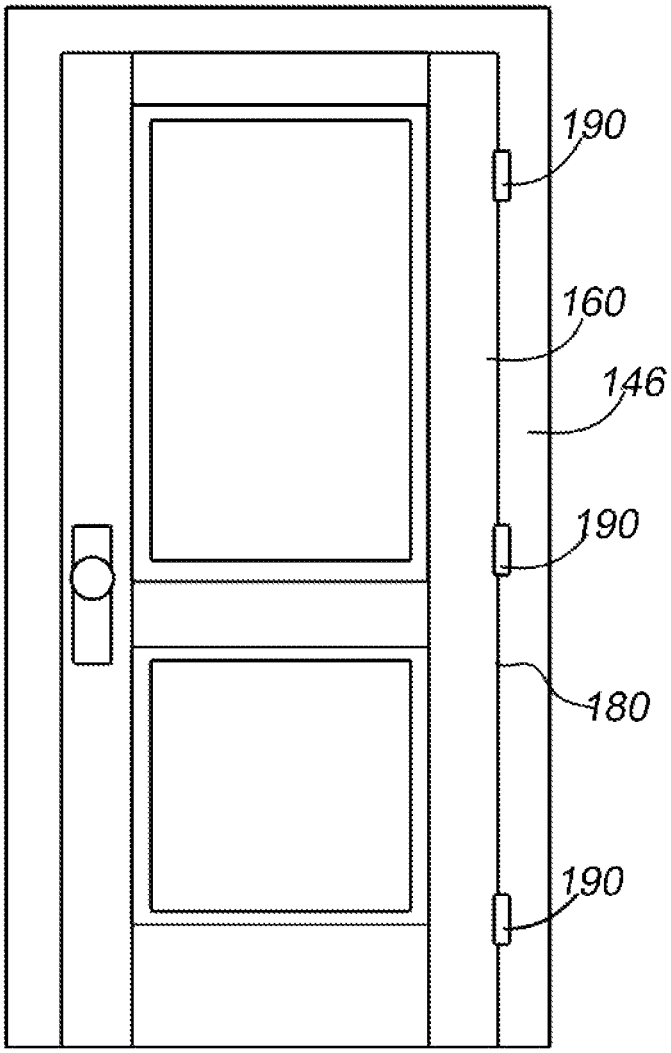
FIG. 8 prior art
FIG. 8 depicts an exemplary prior-art door installation showing space between hinges.

FIG. 7, in order that the particular relationship between the hinge stile gap blocker and the hinge stile gap be clearly understood, depicts a single section of a hinge stile gap blocker 200 affixed to door jamb 142 above hinge 190 and with plate portion 210 aligned with jamb stop 144. However, as shown in (FIG. 9), any distance above, below or between hinges would be typically be occupied by an appropriately sized section.

The following is one exemplary method of installation according to embodiments of the invention:

(1) providing at least one section of a hinge stile gap blocker, wherein the at least one section has an mounting portion and, paired with or joined to the mounting portion, a curved portion;

(2) measuring the distance between hinges on a door jamb;

(3) sectioning or selecting a hinge stile gap blocker length to match the measured distance(s);

(4) aligning edges of the mounting portion to portions of the door jamb so that the hinge stile gap is occluded for all door positions; and, (5) fastening the hinge stile gap blocker to the door jamb.

The following is another exemplary method of installation according to embodiments of the invention:

(1) providing a hinge stile gap blocker having an mounting portion, and, paired with or joined to the mounting portion, a curved portion longitudinal the mounting portion;

(2) measuring the distance between hinges on a door jamb;

(3) selecting sections of the hinge stile gap blocker to fit between hinges mounted to a door jamb;

(4) aligning sides of the mounting portion to portions of the door jamb so that the hinge stile gap is occluded for all door positions; and, (5) fastening the gap blocker to the door jamb.

The following is yet another exemplary method of installation according to embodiments of the invention:

(1) providing a hinge stile gap blocker and a door jamb of a door frame wherein the hinge stile gap blocker is fitted to or incorporated with the door jamb at the time of door jamb manufacture;

(2) fitting hinges to spaces between sections of the hinge stile gap blocker;

(3) aligning and hanging a door to the door frame so that the hinge stile gap is occluded for all door positions.

It should be understood that the drawings and detailed description herein are to be regarded in an illustrative rather than a restrictive manner, and are not intended to be limiting to the particular forms and examples disclosed. For example, while the embodiments shown herein depict multiple sections, it is possible that a single length or section of mounting plate possess separated curved sections, or multiple curved sections joined with a single mounting plate so as to bridge over the hinge portions flush fit with a door jamb. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

What is claimed is:

1. A door safety apparatus for protecting hands and fingers from being pinched between a door and a door jamb comprising:

at least one hinge stile gap blocker member configured to fit within a gap between the door and the door jamb and continuously occlude the gap as the door is moved between an opened state and a closed state, and wherein the hinge stile gap blocker member further comprises:

a solid generally cylindrical member having a longitudinal section thereof removed to form a substantially semi-circular section in cross section and a substantially quarter section in cross section, wherein the semi-circular section forms a first mounting face and the quarter section forms a second mounting face, and a mounting member having a first end, a second end, a first face and a second face, wherein the first face of the mounting member is mounted on the first mounting face of the semi-circular section at the first end, the second end of the mounting member is substantially planar and configured to mount to the door jamb and to reside between the door jamb and the door without interfering with movement of the door to the closed state, and the second face of the mounting member is configured to mount directly to a first side of the door jamb and the second mounting face of the quarter section is configured to mount directly to a second side of the door jamb; and a fastening member for attaching the second face of the mounting member to the first side of the door jamb.

2. The door safety apparatus according to claim 1 wherein said at least one hinge stile gap blocker member comprises a plurality of hinge stile gap blocker members that are configured to mount to the door jamb so as to be vertically aligned with one another.

3. The door safety apparatus according to claim 1 wherein the mounting member extends from the generally cylindrical member.

4. A method of mounting a hinge stile gap blocker member to a door jamb comprising:

positioning the hinge stile gap blocker member within a gap between a door and the door jamb;

the hinge stile gap blocker member comprising a solid generally cylindrical member having a longitudinal section thereof removed to form a substantially semi-circular section in cross section and a substantially quarter section in cross section, wherein the semi-circular section forms a first mounting face and the quarter section forms a second mounting face, and a mounting member having a first end, a second end, a first face and a second face, wherein the first face of the mounting member is mounted on the first mounting face of the semi-circular section at the first end, and the second end of the mounting member is substantially planar;

mounting the second end of the mounting member to the door jamb to reside between the door jamb and the door without interfering with movement of the door to a closed state;

mounting the second face of the mounting member directly to a first side of the door jamb; and mounting the second mounting face of the quarter section directly to a second side of the door jamb, to continuously occlude the gap as the door is moved between an opened state and the closed state.

5. The method according to claim 4 further comprising mounting a plurality of said hinge stile gap blocker members to the door jamb so as to be vertically aligned with one another.

* * * * *